US011267028B2

(12) United States Patent
Kraft et al.

(10) Patent No.: US 11,267,028 B2
(45) Date of Patent: Mar. 8, 2022

(54) ROLLER TOOL FOR A MACHINE TOOL, ROLLER TOOL SYSTEM, AND METHOD FOR THE LINEAR FORMING OF A METAL SHEET

(71) Applicant: PASS Stanztechnik AG, Creußen (DE)

(72) Inventors: Stefan Kraft, Schnabelwaid (DE); Andreas Deuerlein, Egloffstein (DE)

(73) Assignee: PASS Stanztechnik AG, Creußen (DE)

( * ) Notice: Subject to any disclaimer, the term of this patent is extended or adjusted under 35 U.S.C. 154(b) by 220 days.

(21) Appl. No.: 16/504,374

(22) Filed: Jul. 8, 2019

(65) Prior Publication Data

US 2020/0016642 A1 Jan. 16, 2020

(30) Foreign Application Priority Data

Jul. 10, 2018 (DE) ..... 10 2018 211 351.3

(51) Int. Cl.
*B21B 27/02* (2006.01)
*B21D 5/14* (2006.01)

(52) U.S. Cl.
CPC ..... *B21B 27/021* (2013.01); *B21D 5/14* (2013.01)

(58) Field of Classification Search
CPC ... B21D 5/14; B21D 5/06; B21D 5/08; B21D 5/083; B21D 7/08; B21D 17/04; B21B 27/021; B21B 27/00; B21B 27/02; B21B 27/028; B21B 27/06; B21B 35/12; B21B 35/10; B21B 35/00; B21B 35/14; B21B 35/147
See application file for complete search history.

(56) References Cited

U.S. PATENT DOCUMENTS 1,401,260 A * 12/1921 Iverson ..... B21B 35/12 74/665 GA
5,156,034 A 10/1992 Lorbach
5,787,775 A * 8/1998 Stevens ..... B21D 28/12 83/34

(Continued)

FOREIGN PATENT DOCUMENTS

DE 102005003558 A1 7/2006
DE 202005021005 U1 12/2006

(Continued)

OTHER PUBLICATIONS

EP-0714720-A1 Machine Translation (Year: 1996).*
Bytow—EP-0714720-A1 Machine Translation (Translated Apr. 8, 2021) (Year: 1996).*

*Primary Examiner* — Gregory D Swiatocha
*Assistant Examiner* — Bobby Yeonjin Kim
(74) *Attorney, Agent, or Firm* — Smartpat PLC

(57) ABSTRACT

A roller tool for a machine tool for the linear forming of a metal sheet comprises a housing, a tool head which for reversibly interacting with a ram of the machine tool is mounted so as to be rotatable relative to the housing about a tool longitudinal axis, having an impact face for transmitting a contact pressure force that is oriented so as to be parallel to the tool longitudinal axis from the ram to the tool head, and a rotary engagement for transmitting a rotating movement about the tool longitudinal axis from the ram to the tool head, and a roller installation for interacting with the metal sheet, having at least one roller body that is capable of being rotatingly driven by way of the tool head.

10 Claims, 6 Drawing Sheets

(56) References Cited

U.S. PATENT DOCUMENTS

| | | | | |
|---|---|---|---|---|
| 9,207,663 | B2 | 12/2015 | Heusel | |
| 2006/0162413 | A1* | 7/2006 | Bauer | B21D 17/04 72/182 |
| 2007/0105488 | A1 | 5/2007 | Bytow et al. | |
| 2009/0205389 | A1* | 8/2009 | Heusel | G05B 19/195 72/206 |

FOREIGN PATENT DOCUMENTS

| | | | | |
|---|---|---|---|---|
| DE | 102006049045 | A1 | 4/2008 | |
| DE | 102014224094 | A1 | 6/2016 | |
| EP | 0714720 | A1 * | 6/1996 | B23D 19/06 |
| EP | 0714720 | B1 | 12/2000 | |

* cited by examiner

ROLLER TOOL FOR A MACHINE TOOL, ROLLER TOOL SYSTEM, AND METHOD FOR THE LINEAR FORMING OF A METAL SHEET

CROSS-REFERENCES TO RELATED APPLICATIONS

This application claims the priority of German Patent Application, Serial No. 10 2018 211 351.3, filed Jul. 10, 2018, pursuant to 35 U.S.C. 119(a)-(d), the content of which is incorporated herein by reference in its entirety as if fully set forth herein.

TECHNICAL FIELD

The disclosure relates to a roller tool for a machine tool for the linear forming of a metal sheet. The disclosure furthermore relates to a roller tool system having a roller tool of this type as well as to a method for the linear forming of a metal sheet using a roller tool.

BACKGROUND

A roller tool system for a machine tool for the linear forming of a metal sheet is known from U.S. Pat. No. 5,156,034 A. Roller tools of this type are furthermore known from EP 0 714 720 A1, DE 10 2005 003 558 A1, and DE 10 2006 049 045 A1.

SUMMARY

It is an object of the present invention to improve a roller tool. In particular, a roller tool which is capable of being dimensioned in a compact manner and is particularly robust and flexible in operation is to be achieved. The roller tool is in particular to be configured for reliably guaranteeing the machining of metal sheets having a particularly small metal-sheet wall thickness or having a particularly large metal-sheet wall thickness even in the case of high degrees of forming.

This object is achieved by a roller tool for a machine tool for the linear forming of a metal sheet, having a housing; a tool head for reversibly interacting with a ram of the machine tool which is mounted so as to be rotatable relative to the housing about a tool longitudinal axis, having an impact face for transmitting a contact pressure force that is oriented so as to be parallel to the tool longitudinal axis from the ram to the tool head; and a rotary engagement for transmitting a rotating movement about the tool longitudinal axis from the ram to the tool head; and a roller installation for interacting with the metal sheet, having at least one roller body that is capable of being rotatably driven by way of the tool head; characterized in that the rotary engagement is configured as a form-fit profile for transmitting the rotating movement in a form-fitting manner from the ram to the roller tool. It has been recognized that the roller tool having the at least one roller body which by means of a ram of the machine tool is capable of being driven in a rotating manner by way of the rotary engagement of the tool head that is configured as a form-fit profile can be operated in a particularly flexible manner on different machine tools and by way of the ram is capable of being driven reliably and with little wear in a rotating manner. The rotary engagement that is configured as a form-fit profile guarantees the transmission of particularly high torques as well as slip-free and thus precise control of the feed motion that by way of the at least one roller body is transmitted to the metal sheet. Drive components which are cost-intensive and intensive in terms of installation space, in particular drive components which are pivotable conjointly with the roller tool in variable machining directions and/or which are attached to the roller tool, can be dispensed with. For example, the roller tool can thus be used in a machine turret of common machine tools for receiving different machining tools, in particular rolling and stamping tools. The transmission of the rotating movement by way of the tool head which for transmitting the contact pressure force is to be dimensioned in a robust manner, moreover enables a particularly compact configuration of the roller tool. On account of the compact configuration of the roller tool, a larger number of machining tools is capable of being disposed in the same space, on account of which the machining output of the machine tool can be increased. On account of the configuration of a single mechanical interface in the form of the tool head between the machine tool and the roller tool for transmitting both the contact pressure force as well as the rotating movement, the roller tool is capable of being replaced in a particularly simple and rapid manner. The maintenance complexity in terms of the machine and the tool is particularly minor.

The form-fit profile of the rotary engagement can be configured, for example, as a tongue-and-groove connection, in particular as a feather key connection, or as a spline shaft connection. The form-fit profile is particularly preferably configured as a single groove that extends radially in relation to the tool longitudinal axis. The rotary engagement in a plan view can be configured so as to be in the shape of the keyhole. The ram of the machine tool can thus interact with the rotary engagement only in a specific angular position. It is advantageous in particular for the embossing process that an orientation of the at least one roller body that is connected to the tool head is capable of being specified in an unequivocal manner.

The roller tool guarantees the precise forming of metal sheets having a particularly small metal-sheet wall thickness and/or a particularly large metal-sheet wall thickness. The metal-sheet wall thickness of the metal sheet to be machined can be, for example, at most 0.5 mm, in particular at most 0.2 mm, in particular at most 0.1 mm. The metal-sheet wall thickness can also be at least 2.5 mm, in particular at least 3 mm, in particular at least 4 mm. In order for the metal sheet to be formed, the roller body interacts with the metal sheet so as to roll thereon. The at least one roller body herein preferably transmits the contact pressure force and the rotating movement at least proportionally to the metal sheet, in particular in the form of an advancing movement. A repositioning of the metal sheet relative to the roller tool for the linear forming can be performed in a particularly high-output and controlled manner on account of the facilitating rotating movement of the at least one roller body. The precise forming of the metal sheet can thus be reliably guaranteed independently of the machining direction, in particular in the case of machining by pulling and/or pushing.

The roller tool can be configured as a forming tool for forming the metal sheet and/or as an embossing tool for embossing the metal sheet and/or as a separating tool for separating the metal sheet. The roller tool embodied as a forming tool can be configured for forming corrugations, for example.

According to one aspect of the disclosure, the rotary engagement is configured for reversibly interacting with the tool head. This is to be understood to mean that by way of the rotary engagement the ram is capable of being reversibly connected to the tool head. For example, the rotary engagement can have a clamping face for connecting to the ram in a force-fitting manner. The roller tool is thus capable of being disposed in the machine turret of the machine tool, and is replaceable in an automated manner.

The at least one roller body is preferably mounted on the housing so as to be rotatable about a rotation axis that is oriented so as to be vertical to the tool longitudinal axis. A machining direction in which the metal sheet when forming is repositioned relative to the roller tool is preferably oriented so as to be perpendicular to the tool longitudinal axis and perpendicular to the rotation axis of the at least one roller body.

According to one aspect of the disclosure the roller tool has at least two, in particular at least three, in particular at least four, roller bodies which are capable of being rotatingly driven by way of the tool head. The plurality of roller bodies can be driven by way of a common roller shaft. Alternatively, at least two of the roller bodies are capable of being rotatingly driven in a mutually independent manner. For example, the at least two roller bodies can be connected to one another by way of a gearbox, in particular a differential. On account thereof it is advantageously achieved that the machining of the metal sheet can be performed in a particularly flexible and precise manner.

According to one aspect of the disclosure the housing has an indexing engagement for rotatingly driving the roller tool about the tool longitudinal axis by means of an indexing drive of the machine tool. In order for the metal sheet to be formed in a linear manner along a curved forming path, the roller tool can be rotated so as to correspond to the repositioning of the metal sheet relative to the roller tool. In particular, the rotation axis of the at least one roller body can be oriented so as to be perpendicular to the machining direction.

According to one further aspect of the disclosure the roller tool comprises a lubricating installation for lubricating the movably mounted components, in particular the at least one roller body. The tool head can have a head bore for feeding cooling lubricant by way of the ram into the roller tool. The head bore can penetrate the tool head so as to be concentric with the tool longitudinal axis. According to one aspect of the disclosure the roller shaft has a lubricant duct for lubricating a rotary bearing that is configured between the rotary shaft and the housing. The mounting of the roller shaft and the housing is thus particularly minimized in terms of friction and wear.

A roller tool comprising a bevel gear mechanism and/or a worm gear mechanism for transmitting the rotating movement between the tool head and the roller body, is particularly minimized in terms of friction and thus capable of being operated in an efficient manner. The rotating movement about the tool longitudinal axis, by means of the bevel gear mechanism and/or the worm gear mechanism, can be converted to a rotating movement that is oriented so as to be inclined to the former, in particular oriented so as to be perpendicular to the former. To this end, the bevel gear mechanism and/or the worm gear mechanism can be configured as mitre gear mechanisms. A transmission ratio of the bevel gear mechanism and/or the worm gear mechanism is preferably at most 5, in particular at most 3, in particular at most 2, in particular at most 1.5. A transmission ratio of the bevel gear mechanism and/or the worm gear mechanism is preferably 1. The rotating movement in the tool longitudinal axis can thus be converted with particularly little friction to the rotating movement of the roller shaft that is oriented so as to be perpendicular to the former.

A roller tool comprising a spur gear mechanism for transmitting the rotating movement between the tool head and the roller body, is capable of being dimensioned in a particularly compact manner. At least one spur gear mechanism, in particular at least two spur gear mechanisms, is/are disposed for transmitting the rotating movement between the tool head and the roller body. The at least one spur gear mechanism and/or the bevel gear mechanism and/or the worm gear mechanism, in particular gears thereof, can be dimensioned in a particularly compact manner independently of a diameter of the at least one roller body. A maximum diameter of each sprocket of the at least one spur gear mechanism is preferably at most the size of a maximum diameter of the at least one roller body.

A roller tool comprising at least two shafts which for transmitting the rotating movement between the tool head and the roller body are oriented so as to be perpendicular to the tool longitudinal axis and are disposed so as to be mutually spaced apart along the tool longitudinal axis, is capable of being dimensioned in a particularly compact manner. The roller tool for supporting the at least one roller body preferably comprises at least one roller shaft, and for supporting at least one sprocket at least one sprocket shaft, in particular at least two, in particular at least three, sprocket shafts which is/are oriented so as to be perpendicular to the tool longitudinal axis. The at least one roller shaft and the at least one sprocket shaft are preferably disposed so as to be mutually spaced apart in particular along the tool longitudinal axis. The at least two shafts for transmitting the rotating movement can be mounted so as to be rotatable on the housing.

According to one aspect of the disclosure at least one of the shafts, in particular the at least one roller shaft and/or the at least one sprocket shaft, has a bevel gear notch. The roller shaft and/or the sprocket shaft along the rotating direction thereof preferably overlap one bevel gear of the bevel gear mechanism. On account thereof, the roller tool is capable of being dimensioned in a particularly compact manner.

A roller tool comprising a safety clutch for limiting a maximum torque transmittable between the tool head and the roller body, is particularly robust and capable of being operated in a reliable manner. In the case of the form-fitting connection between the ram and the tool head it is particularly advantageous for provisions in terms of construction to be made which enable said connection to be released when pre-specified moments are exceeded. The safety clutch can in particular serve for avoiding damage to the machine tool and/or to the roller tool. The safety clutch can have a driving part and an output part. The driving part can be connected to the tool head so as to be capable of being rotatingly driven by way of a head-to-clutch connection, in particular by way of a feather key connection. The safety clutch can be reversibly repositionable between a closed position and an opened position. The output part in the closed position is preferably connected to the driving part so as to be capable of being rotatingly driven. The transmission of the rotating movement between the driving part and the output part in the opened position can at least be partially, in particularly fully, interrupted. The safety clutch is preferably configured so as to be self-triggering. The self-triggering safety clutch, when exceeding the maximum transmissible torque, is repositioned from the closed position to the opened position only by the torque bearing thereon. Any damage to the roller tool on account of an excessive torque transmitted from the ram to the tool head can thus be prevented. Damage to the machine tool, for example by virtue of the at least one roller body being blocked, can in particular also be avoided.

A maximum torque transmittable by way of the safety clutch is preferably adjustable. To this end, the safety clutch can have a clutch spring, for example. The clutch spring can be capable of pretensioning in a stepless manner, in particular by means of a spring nut. The safety clutch is preferably configured as a load-separating clutch which is in particular free of any residual moments, or as a load-retaining clutch in particular having a friction-fit.

According to one aspect of the disclosure the safety clutch has a trigger sensor for detecting a repositioning of the safety clutch from a closed position to an opened position.

A roller tool wherein a driving part of the safety clutch is connected directly to the tool head, is particularly robust and capable of being operated in a reliable manner. The direct connection is in particular to be understood to mean that no torque/rotating speed conversion is performed between the tool head and the driving part. The driving part is preferably connected to the safety clutch without a gearbox and/or in a rotatably fixed manner, in particularly a rigid manner. The output part can be connected to the at least one roller body so as to be capable of being rotatingly driven. On account of the safety clutch being disposed directly on the tool head it is prevented that any damage to the roller tool on the output side, in particular any damage to the bevel gear mechanism and/or the spur gear mechanism, or any blocking of the at least one roller body, leads to an overload on components on the input side. Any damage of a ram drive of the machine tool can thus be reliably prevented.

A roller tool wherein the roller installation has a secondary roller body which for interacting with the metal sheet is mounted on a roller shaft that transmits the rotating movement so as to be rotatable relative to the roller body, guarantees precise and efficient forming of the metal sheet. The roller installation preferably comprises at least one secondary roller body, in particular at least two, in particular at least three, in particular at least five, secondary roller bodies which is/are rotatably mounted so as to be transverse to the tool longitudinal axis. On account thereof it is advantageously achieved that workpiece forming can also be performed precisely along a very curved forming path. The at least one secondary roller body can be disposed so as to be spaced apart from the roller body. A roller sleeve can in particular be disposed between the roller body and the at least one secondary roller body. Alternatively, the at least one secondary roller body can be disposed directly beside the roller body.

A circumferential contour of the at least one roller body and/or of the at least one secondary roller body preferably corresponds to a shape to be transferred to the metal sheet. The at least one secondary roller body is preferably not driven.

A roller tool comprising a lubricant duct which for feeding lubricant to the secondary roller body is incorporated in the roller shaft, is particularly efficient and capable of being operated with little wear. The roller shaft preferably comprises a lubricant reservoir in the form of a central bore. The lubricant duct incorporated in the roller shaft can connect the lubricant reservoir in a lubricant-fluidic manner to a bearing location of the roller shaft and/or of the at least one secondary roller body and/or of the roller sleeve.

The disclosure is furthermore based on the object of achieving a roller tool system which is capable of being dimensioned in a compact manner and when in operation is particularly robust and flexible. Furthermore, a roller tool system which is configured for forming metal sheets having a particularly small metal-sheet wall thickness or a particularly large metal-sheet wall thickness is to be achieved.

This object is achieved by a roller tool system having a roller tool and a counter roller tool having a counter housing; at least one counter roller which for interacting with the metal sheet is mounted so as to be rotatable in the counter housing. The advantages of the roller tool system correspond to the advantages of the roller tool already described. The counter roller tool preferably comprises at least one counter roller, in particular at least two, in particular at least three, in particular at least five, counter rollers, said counter roller/counter rollers being rotatably mounted on a counter roller axle. The at least one counter roller is preferably configured as a forming roller. The at least one forming roller is characterized in that said forming roller has a circumferential geometry which in the forming process is capable of being transferred to the metal sheet. Alternatively, the at least one roller body and/or the at least one secondary roller body can also be configured as a forming roller. The at least one counter roller can be configured as a counter roller body. The at least one counter roller body is characterized in that said counter roller body is configured for guiding the metal sheet, in particular for holding down the metal sheet, during forming.

According to one aspect of the disclosure the at least one counter roller is capable of being rotatingly driven. To this end, the counter roller tool can have a counter roller drive which is connected to the at least one counter roller so as to be capable of being rotatingly driven.

The disclosure is furthermore based on the object of improving a method for the linear forming of a metal sheet.

This object is achieved by a method for the linear forming of a metal sheet, comprising the following steps: providing a roller tool for a machine tool, having a tool head and a roller installation having at least one roller body; providing the metal sheet; pressing the roller body onto the metal sheet by exerting a contact pressure force from a ram of the machine tool onto the tool head; rotatingly driving the roller body that interacts with the metal sheet by transmitting a rotating movement in a form-fitting manner from the ram to a rotary engagement of the tool head that is configured as a form-fit profile; repositioning the metal sheet relative to the roller tool for forming the metal sheet in a linear manner. The advantages of the method correspond to the advantages of the roller tool, or the roller tool system, respectively, already described. According to one aspect of the disclosure the metal sheet is repositioned relative to the roller tool so as to pull and/or push. A pulling repositioning of the metal sheet is understood to mean that the metal sheet is pulled in the direction away from the roller tool. The pushing machining is understood to mean that the metal sheet is pushed in the direction of the roller tool. To this end, the metal sheet can be fastened to a positioning installation, in particular a metal-sheet clamping means, of the machine tool. In the case of the pulling machining, the metal-sheet clamping means is moved away from the roller tool. In the case of the pushing machining, the metal-sheet clamping means is moved in the direction of the roller tool. Alternatively, for repositioning the metal sheet the metal-sheet clamping means can be moved relative to the roller tool in a manner parallel to the machining direction.

A method wherein the rotating driving of the roller body is performed so as to be adapted to the repositioning of the metal sheet relative to the roller tool, guarantees particularly precise machining of the metal sheet. The rotable driving of the roller body can be coupled to the repositioning of the metal sheet relative to the roller tool. To this end, the ram drive and the positioning installation can be connected in terms of signalling with a control installation of the machine tool. The indexing drive for the rotatable driving of the roller tool system about the tool longitudinal axis is preferably also connected in terms of signalling to the control installation. The indexing drive and/or the ram drive and/or a positioning drive of the positioning installation are preferably operated so as to be mutually adapted by means of the control installation. The rotating movement of the roller body as well as the orientation of the rotation axis of the roller body can thus be adapted to the movement of the metal sheet relative to the roller tool. Bulging and/or creasing of the metal sheet can thus be reliably prevented even in the case of high degrees of forming.

A method wherein a maximum torque transmittable between the tool head and the roller body is limited by means of a safety clutch (27), is particularly robust when in operation. The safety clutch is preferably transferred from the closed position to the opened position when the maximum transmittable torque is exceeded. The transmission of torque between the tool head and the at least one roller body herein can be interrupted, in particular be completely severed or be reduced to a constant residual moment.

Further features, advantages, and details of the invention are derived from the description hereunder of an exemplary embodiment.

DETAILED DESCRIPTION

Figure 1:
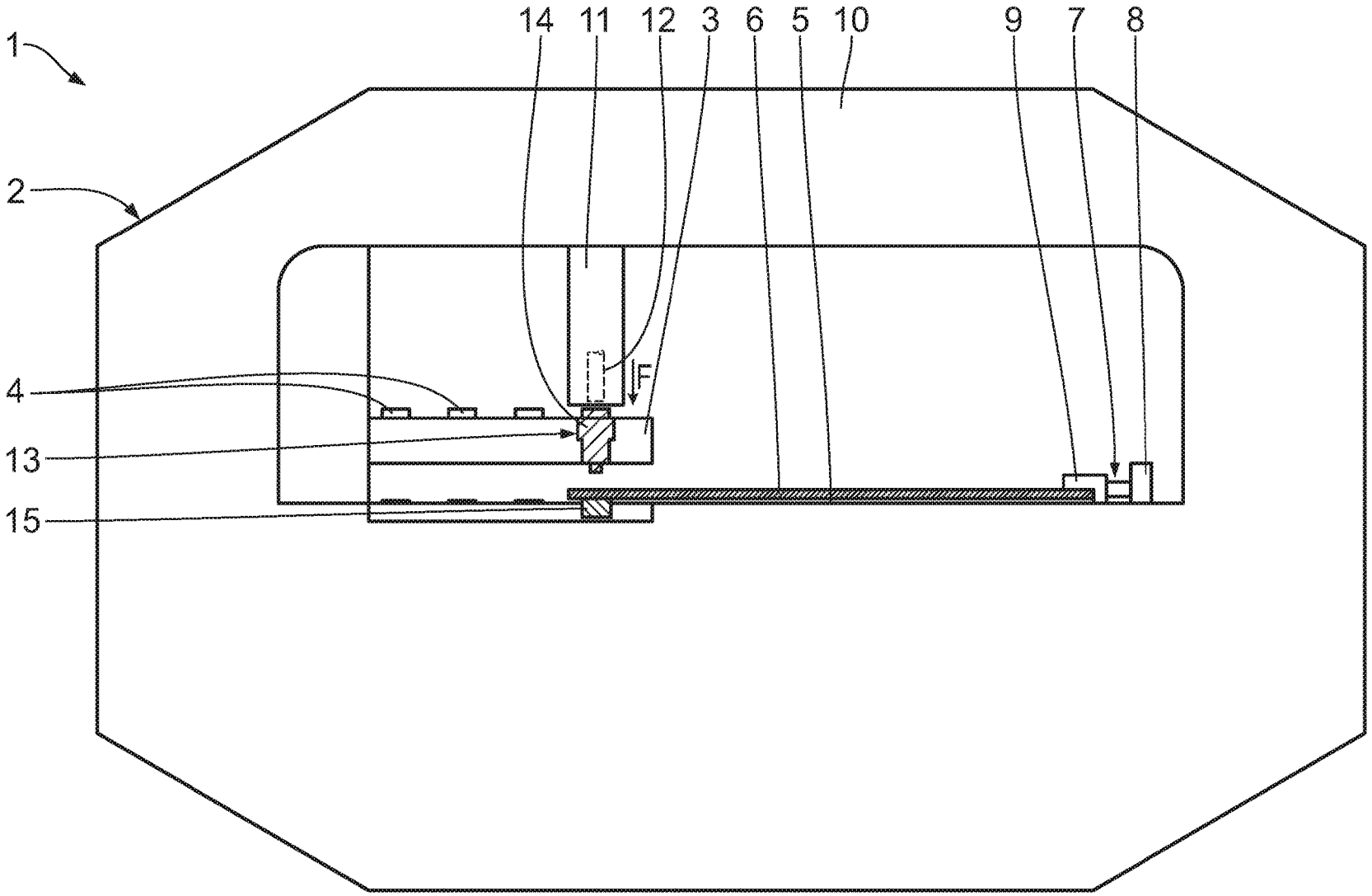
FIG. 1 shows a lateral view of a schematically illustrated machine tool having a roller tool system.

A machine tool 1 as is illustrated in FIG. 1 comprises a frame structure 2, a machine turret 3, connected to said frame structure 2, for receiving machining tools 4, a machining table 5 for supporting a metal sheet 6 to be machined, and a positioning installation 7 for repositioning the metal sheet 6 relative to the machining table 5.

The positioning installation 7 comprises a positioning drive 8 which is operatively connected to a metal-sheet clamping means 9. The metal sheet 6 is reversibly fastened to the metal-sheet clamping means 9 and by means of the positioning drive 8 is repositionable relative to the machining table 5.

An activation means 11 having a ram 12 is disposed on a frame upper part 10 of the frame structure 2. The activation means 11 by way of the ram 12 interacts with the respective machining tool 4 that is disposed thereunder. To this end, the ram 12 for exerting a contact pressure force F on the machining tool 4 is repositionable in the vertical direction, and for transmitting a rotating movement to the machining tool 4 is capable of being rotatingly driven about a vertical axis.

The machine turret 3 is mounted so as to be capable of being rotatingly driven on the frame structure 2. Various machining tools 4 are capable of being disposed below the activation means 11 by rotatingly driving the machine turret 3.

The machining tool 4 that is disposed below the activation means 11 is configured as a roller tool system 13. The roller tool system 13 comprises a roller tool 14 and a counter roller tool 15. The metal sheet 6 is disposed between the roller tool 14 and the counter roller tool 15.

Figure 2:
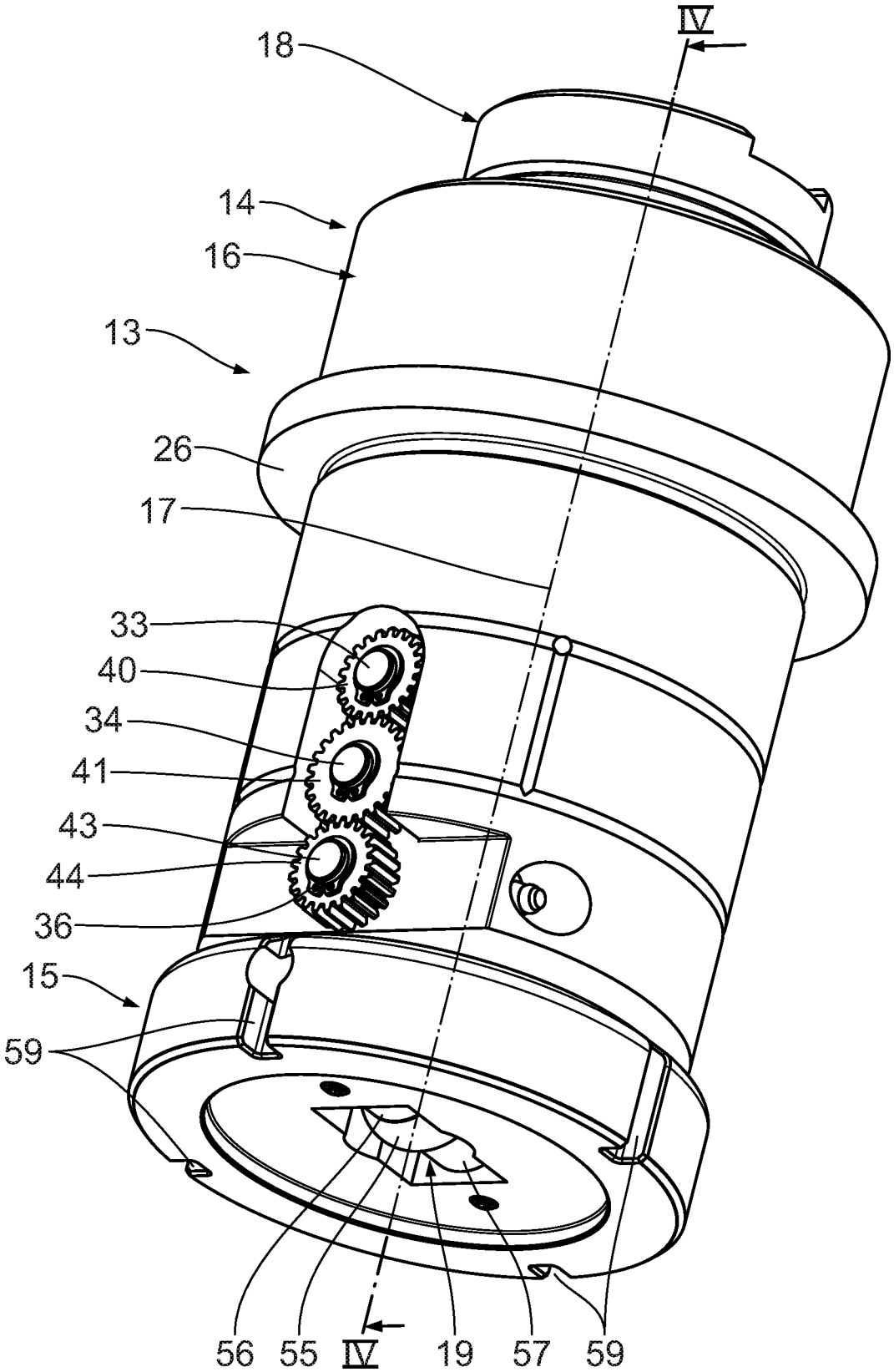
FIG. 2 shows a perspective illustration of the roller tool system in FIG. 1, seen from obliquely below, having a roller tool and a counter roller tool, wherein the roller tool has a roller installation having a roller body which for interacting with a metal sheet is capable of being rotatingly driven.

The roller tool system 13 is illustrated in more detail in FIG. 2. The roller tool 14 has a housing 16, a tool head 18 which is mounted so as to be rotatable relative to the housing 16 about a tool longitudinal axis 17, and a roller installation 19 which for interacting with the metal sheet 6 is connected to the housing 16.

Figure 3:
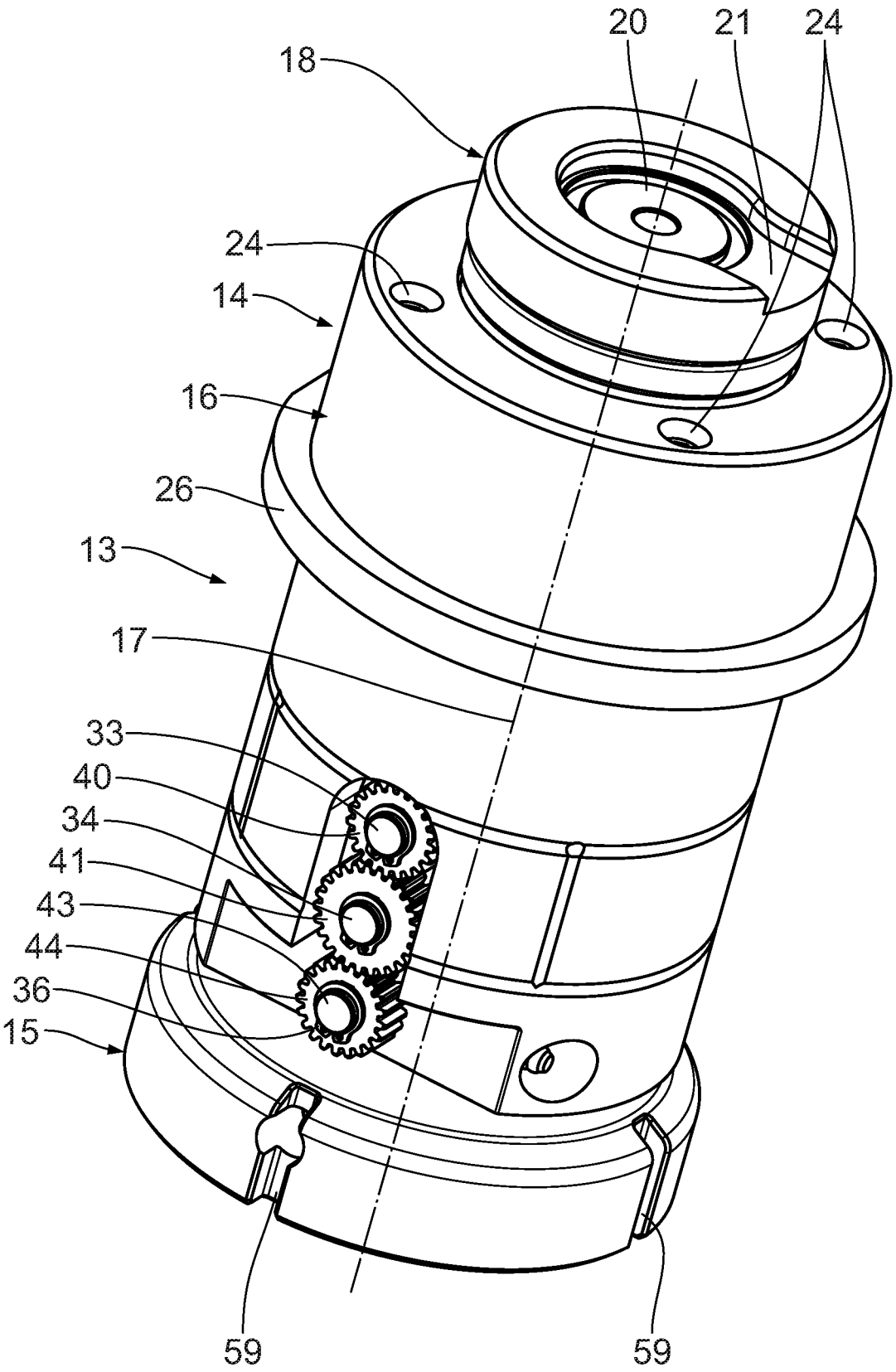
FIG. 3 shows a perspective illustration of the roller tool systems in FIG. 1, seen from obliquely above, wherein the roller tool has a tool head having a rotary engagement for transmitting a rotating movement from a ram of the machine tool to the tool head.

As is derived in particular from FIG. 3, the tool head 18 for reversibly interacting with the ram 12 comprises an impact face 20 and a rotary engagement 21. The impact face 20 is configured such that the contact pressure force F that is oriented so as to be parallel to the tool longitudinal axis 17 by way of said impact face 20 is transmittable from the ram 12 to the tool head 18. The rotating movement about the tool longitudinal axis 17 by way of the rotary engagement 21 is transmittable from the ram 12 to the tool head 18. The rotary engagement 21 for interacting in a form-fitting manner with the ram 12 about the tool longitudinal axis 17 is configured as a groove that extends radially in relation to the tool longitudinal axis 17. In order for the rotary engagement 21 to be configured, the tool head 18 thus has a keyhole-shaped depression.

Figure 4:
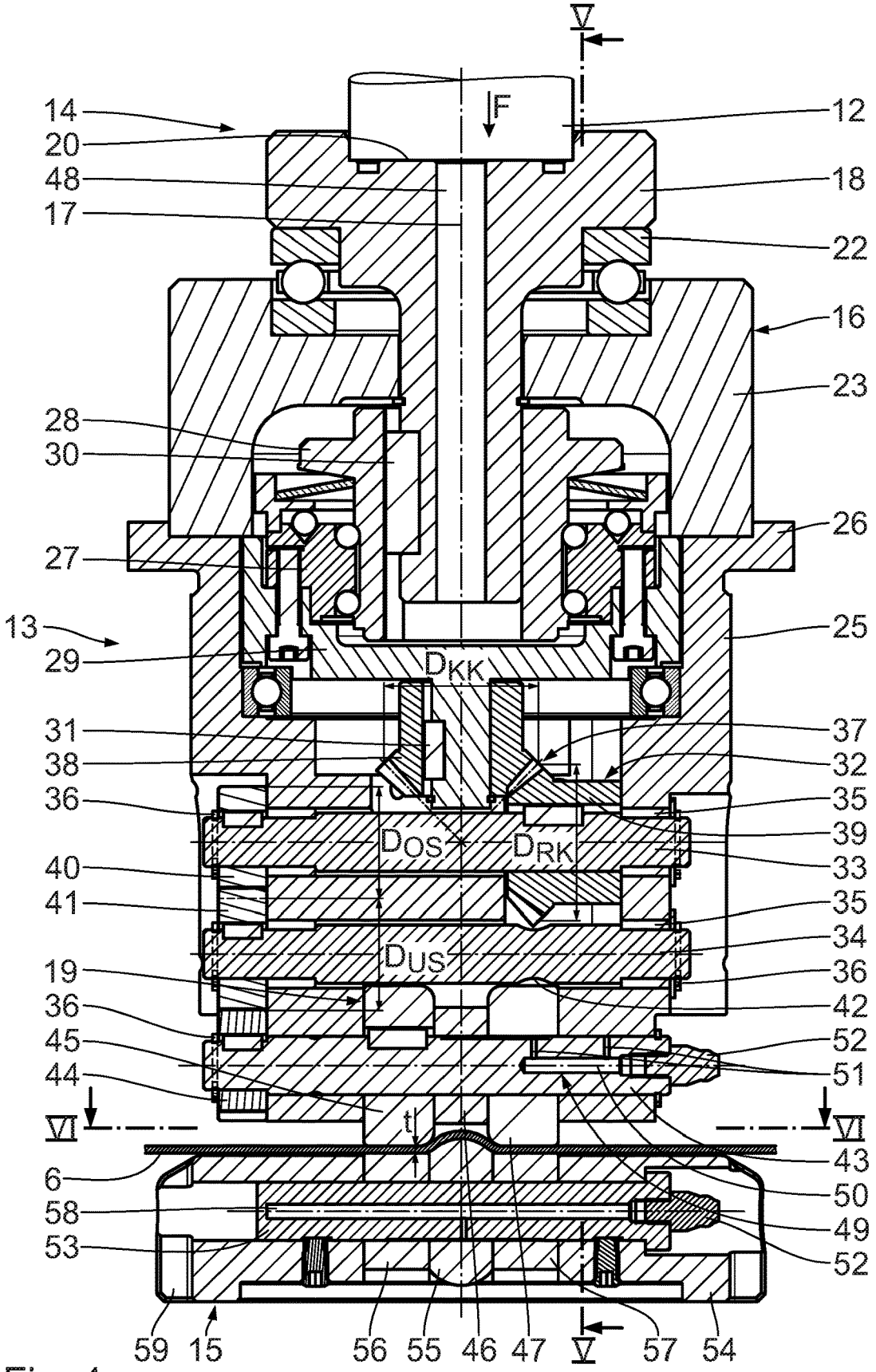
FIG. 4 shows a sectional illustration of the roller tool system along the section line IV-IV in FIG. 2, through a tool longitudinal axis, wherein the metal sheet for the linear forming is disposed between the roller tool and the counter roller tool.
Figure 5:
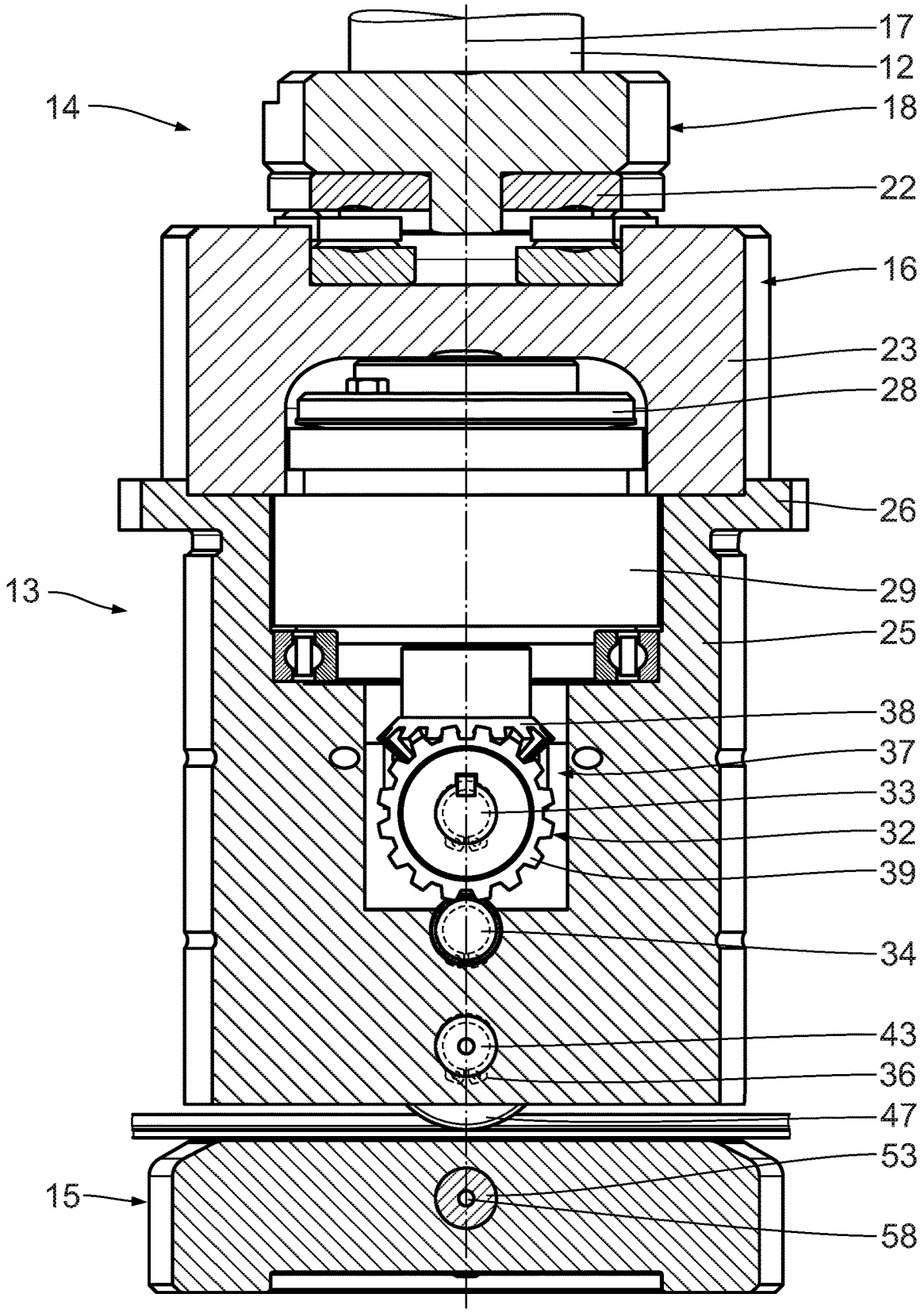
FIG. 5 shows a sectional illustration of the roller tool system along the section line V-V in FIG. 4, parallel to and spaced apart from the tool longitudinal axis, wherein a safety clutch of the roller tool is illustrated in a non-sectional manner.
Figure 6:
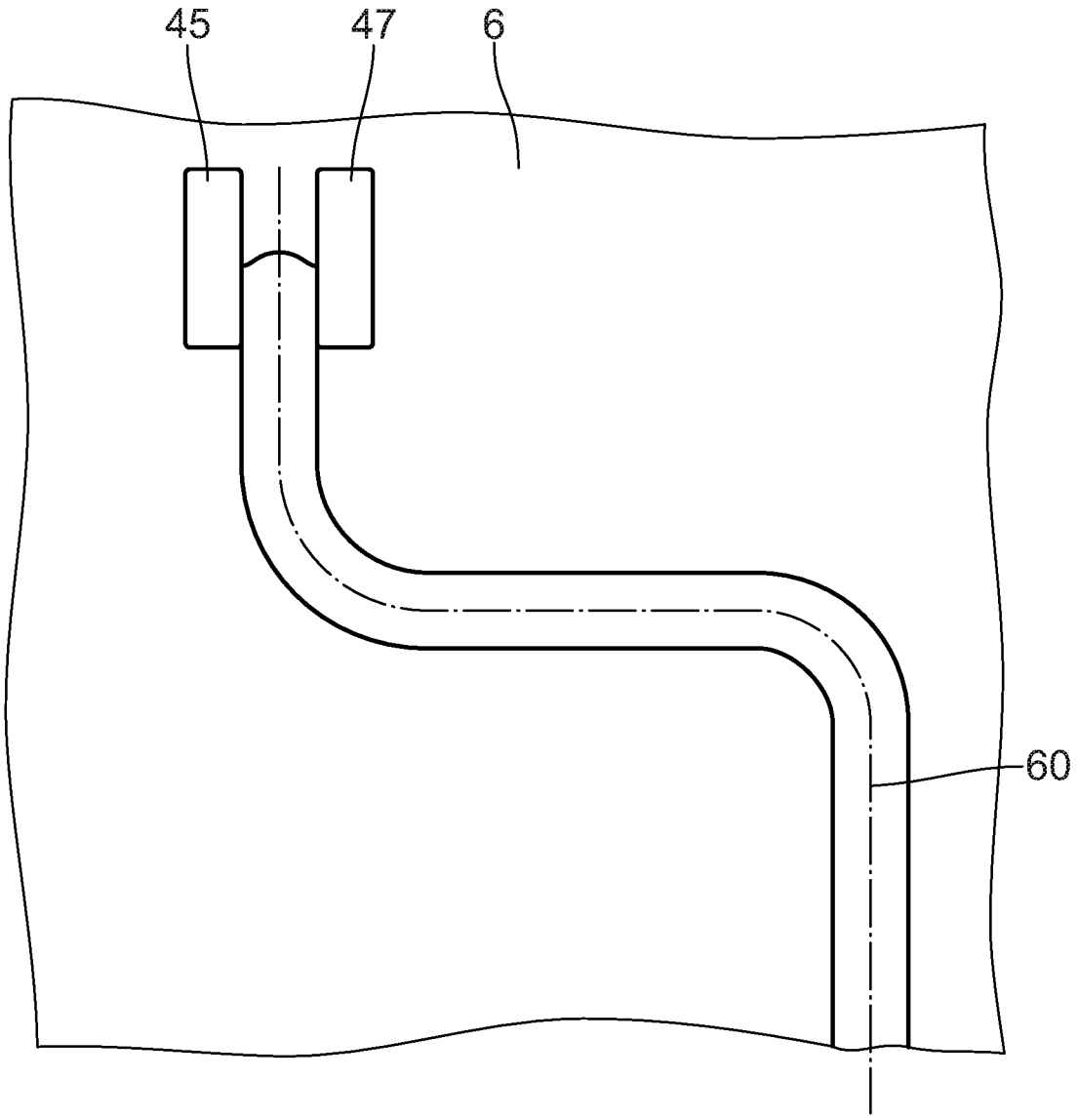
FIG. 6 shows a sectional illustration of the roller tool system along the section line VI-VI in FIG. 4, having the metal sheet formed in a linear manner along a forming path.

A longitudinal section of the roller tool system 13 through the tool longitudinal axis 17 is illustrated in FIG. 4. The tool head 18 by way of a head bearing 22 on a housing upper part 23 of the housing 16 is mounted so as to be rotatable about the tool longitudinal axis 17. The head bearing 22 is configured as a ball bearing. The housing upper part 23 by means of a housing screw fitting 24 is connected in a force-fitting manner to a housing lower part. The housing lower part 25 has a housing flange 26 for connecting to the machine turret 3. The housing 16 by means of an indexing drive (not illustrated) of the machine tool 1, in particular by way of the housing upper part 23, is capable of being rotatingly driven about the tool longitudinal axis 17 relative to the machine turret 3.

The tool head 18 is connected in a rotationally fixed manner to a safety clutch 27. The safety clutch 27 has a driving part 28 and an output part 29. The driving part 28 by way of a head-to-clutch connection 30 is connected in a rotationally fixed manner to the tool head 18. The head-to-clutch connection 30 comprises a feather key connection. The safety clutch 27 is capable of being disposed in a closed position and in an opened position. The output part 29 in the closed position is connected in a rotationally fixed manner to the driving part 28. The output part 29 in the opened position is rotatable about the tool longitudinal axis 17 relative to the driving part 28. The safety clutch 27 is configured in such a manner that said safety clutch 27 is repositionable between the closed position and the opened position, depending on the torque bearing on the driving part 28. The safety clutch 27 is repositioned in a self-acting manner from the closed position to the opened position when a maximum transmittable torque is exceeded.

The safety clutch 27, in particular the output part 29, by way of a clutch-to-gear connection 31 is connected in a rotation-transmitting manner to a gear installation 32. The clutch-to-gear connection 31 comprises a feather key connection for transmitting the rotating movement in a form-fitting manner from the safety clutch 27 to the gear installation 32. Said gear installation 32 has two sprocket shafts 33, 34 which are mounted so as to be rotatable on the housing 16, in particular on the housing lower part 25. A rotation axis of the respective sprocket shaft 33, 34 is oriented so as to be perpendicular to the tool longitudinal axis 17. The sprocket shafts 33, 34 by way of friction bearing bushes 35 are mounted so as to be rotatable on the housing lower part 25. The sprocket shafts 33, 34 in the axial direction are fastened to the housing lower part 25 by means of securing rings 36.

The output part 29 for rotatingly driving the upper sprocket shaft 33 is connected to the upper sprocket shaft 33 so as to be capable of being rotatingly driven by way of a bevel gear mechanism 37. A diameter $D_{KK}$ of a clutch bevel gear 38 disposed on the safety clutch 27 is 15% smaller than a diameter $D_{RK}$ of a sprocket bevel gear 39 that is disposed on the upper sprocket shaft 33. The sprocket bevel gear 39 by way of a feather key connection is connected in a form-fitting manner to the upper sprocket shaft 33.

The upper sprocket shaft 33 for transmitting the rotating movement from the upper sprocket shaft 33 to the lower sprocket shaft 34 has an upper spur gear 40 that is connected to said upper sprocket shaft 33 in a rotationally fixed manner, and the lower sprocket shaft 34 has a lower spur gear 41 that is connected to said lower sprocket shaft 34 in a rotationally fixed manner. A diameter Dos of the upper spur gear 40 is equal to a lower diameter $D_{US}$ of the lower spur gear 41. The lower sprocket shaft 34 in the region of the sprocket bevel gear 39 has a bevel gear notch 42. In a lateral view in the direction of the rotation axis of the lower sprocket shaft 34, the lower sprocket shaft 34 and the sprocket bevel gear 39 mutually overlap.

The gear installation 32 comprises a roller shaft 43 which is mounted so as to be rotatable on the housing 16, in particular on the housing lower part 25. The roller shaft 43 is axially established on the housing lower part 25 by means of securing rings 36. The roller shaft 43 by way of a roller sprocket 44 that is connected in a rotationally fixed manner to said roller shaft 43 and by way of the lower spur gear 41 is connected to the lower sprocket shaft 34 so as to be capable of being rotatingly driven.

The roller installation 19 for interacting with the metal sheet 6 comprises a roller body 45. The roller body 45 by way of a feather key connection is connected in a rotationally fixed manner to the roller shaft 43. The roller body 45 by way of the gear installation 32 and the safety clutch 27 is connected to the tool head 18 so as to be capable of being rotatably driven. The roller body 45 for interacting with the metal sheet 6 has a hardened metallic surface.

The roller installation 19 has a roller sleeve 46 and a secondary roller body 47. The roller sleeve 46 and the secondary roller body 47 are rotatably mounted on the roller shaft 43. The secondary roller body 47 for interacting with the metal sheet 6 has a surface from a hardened metallic material.

The tool head 18 for feeding cooling lubricant from the ram 12 to the roller tool 14 has a head bore 48. The roller shaft 43 comprises a lubricant duct 49. The lubricant duct 49 comprises a central bore 50 that is disposed so as to be concentric with the roller shaft 43, and branch ducts 51 which extend radially between the central bore 50 and the housing lower part 25, the roller sleeve 46, and the secondary roller body 47. A lubricating nipple 52 for introducing lubricant into the lubricant duct 49 is disposed on the central bore 50.

The counter roller tool 15 comprises a counter roller axle 53. The counter roller axle 53 is attached so as to be rotationally fixed on a counter housing 54. A forming roller 55 and two counter roller bodies 56, 57 are rotatably mounted on the counter roller axle 53, said counter roller bodies 56, 57 being disposed so as to neighbour said forming roller 55. The forming roller 55 and the two counter roller bodies 56, 57 are configured for interacting with the metal sheet 6. To this end, the forming roller 55 and the counter roller bodies 56, 57 have a hardened metallic surface.

The counter roller axle 53 comprises a counter lubricant duct 58 which is connected to the forming roller 55 and the counter roller bodies 56, 57. Lubricant can be introduced into the counter lubricant duct 58 by way of a lubricating nipple 52.

The counter housing 54 is mounted on the machine tool 1 so as to be rotatable relative to the machine turret 3. The counter housing 54 by way of a drive engagement 59 is capable of being rotatably driven by means of the indexing drive.

The functional mode of the roller tool system 13 having the roller tool 14 and the counter roller tool 15 is as follows:

The roller tool system 13 is initially disposed in a resetting position. The roller tool system 13 in the resetting position is disposed below the activation means 11, wherein the tool head 18 is disposed below the ram 12. The metal sheet 6 is disposed between the roller tool 14 and the counter roller tool 15. The roller tool 14 is disposed so as to be spaced apart, in particular in the vertical direction, from the metal sheet 6.

The metal sheet 6 by activating the positioning installation 7 is repositioned relative to the roller tool system 13. A region of the metal sheet 6 to be machined is disposed in the vertical direction above the forming roller 55. The roller tool 14 for the linear forming of the metal sheet 6 is repositioned in the vertical downward direction by means of the ram 12. To this end, the ram 12 interacts with the impact face 20 of the tool head 18. The contact pressure force F is transmitted from the ram 12 to the metal sheet 6 by way of the tool head 18, the housing 16, the roller shaft 43, as well as the roller body 45 and the secondary roller body 47. The roller tool 14 is situated in the operating position.

The metal sheet 6 is guided between the roller body 45 and the first counter roller body 56, as well as between the secondary roller body 47 and the second counter roller body 57. The metal sheet 6 is formed by means of the forming roller 55.

The metal sheet 6 for the linear forming thereof is repositionable relative to the roller tool system 13 by means of the positioning installation 7. The metal sheet 6 is repositioned relative to the roller tool system 14 in a manner substantially perpendicular to the tool longitudinal axis 17 and to the rotation axis of the roller shaft 43. To this end, the metal-sheet clamping means 9 can be repositioned relative to the roller tool system 13 in an arbitrary direction, in particular in the direction of the roller tool system 13.

The metal sheet 6, by repositioning the metal sheet 6 along a forming path 60 relative to the roller tool system 13 disposed in the operating position is formed, in particular in a corrugated manner. The roller body 45, the secondary roller body 47, the first counter roller body 56, the second counter roller body 57, and the forming roller 55 hereby role on the metal sheet 6. The forming path 60 is configured so as to be curved. The metal sheet 6 is formed along a curved line by rotating the roller tool system 13 by means of the indexing drive, in particular while repositioning the metal sheet 6 relative to the roller tool system 13.

The rotating movement is transferred from the ram 12 to the tool head 18 by way of the rotary engagement 21. The rotating movement is transmitted from the tool head 18 by way of the safety clutch 27 and the gear installation 32 to the roller body 45. The rotating movement of the roller body 45 is adapted to the repositioning of the metal sheet 6 relative to the roller tool system 13. In particular, the rotating movement of the roller body 45 is adapted to the rotating movement of the roller tool system 13 relative to the metal sheet 6. To this end, the indexing drive, the activation means 11, and the positioning installation 7 are connected in terms of signalling to a control installation of the machine tool 1.

The roller body 45 in a curved region of the forming path 60 is driven in such a manner that a circumferential rolling speed of the roller body 45 is higher or lower than a relative speed of the roller tool system 13, relative to the metal sheet 6, in the region of the tool longitudinal axis 17. The circumferential rolling speed on straight portions of the forming path 60 corresponds to the relative speed between the metal sheet 6 and the roller tool system 13. On account thereof, particularly thick metal sheets 6, in particular having a metal-sheet wall thickness t of more than 2.5 mm, can be reliably formed. Thin metal sheets 6 having a metal-sheet wall thickness t of at most 0.5 mm can be reliably formed without creasing.

Cooling lubricant is fed to the roller tool system 13 during the forming process by way of the head bore 48. For minimizing friction and wear, lubricant by way of the lubricant duct 49 and the counter lubricant duct 58 is delivered between the roller shaft 43 and the roller sleeve 46, the secondary roller body 47 and the housing lower part 25, as well as between the counter roller axle 53 and the counter roller bodies 56, 57 and the forming roller 55.

The safety clutch 27 is repositioned from the closed position to the opened position when a maximum torque transmittable between the tool head 18 and the roller body 45, in particular between the driving part 28 and the output part 29 is exceeded. The driving part 28 in the opened position is rotatable relative to the output part 29, wherein the transmission of the rotating movement between the tool head 18 and the roller body 45 is interrupted.

The roller tool system 13 having the roller body 45 that by way of the tool head 18 is capable of being rotatingly driven is dimensioned in a compact manner, is robust when in operation, and can be used in a particularly flexible manner. The roller tool system 13 enables the linear forming of the metal sheet 6 along the straight and/or curved forming path 60 in a flexible and reliable manner, wherein metal sheets 6 having a particularly small metal-sheet wall thickness t of at most 0.5 mm, as well as metal sheets 6 having a particularly large metal-sheet wall thickness t of at least 2.5 mm can be formed in particular. The roller tool system 13 for forming the metal sheet 6 herein can be repositioned relative to the metal-sheet clamping means 9 in an arbitrary direction, in particular in the direction of the metal-sheet clamping means 9, without bulging or creasing of the metal sheet 6 arising.

What is claimed is:

1. A roller tool for a machine tool for the linear forming of a metal sheet, comprising a housing;

a tool head for reversibly interacting with a ram of the machine tool which is mounted so as to be rotatable relative to the housing about a tool longitudinal axis, with an impact face for transmitting a contact pressure force that is oriented so as to be parallel to the tool longitudinal axis from the ram to the tool head; and a rotary engagement for transmitting a rotating movement about the tool longitudinal axis from the ram to the tool head; and a roller installation for interacting with the metal sheet, with at least one roller body that is capable of being rotatably driven by way of the tool head; and a safety clutch for limiting a maximum torque transmittable between the tool head and the roller body;

wherein the rotary engagement is configured as a form-fit profile for transmitting the rotating movement in a form-fitting manner from the ram to the roller tool.

2. The roller tool according to claim 1, comprising at least one of the group comprising a bevel gear mechanism and a worm gear mechanism for transmitting the rotating movement between the tool head and the roller body.

3. The roller tool according to claim 1, comprising a spur gear mechanism for transmitting the rotating movement between the tool head and the roller body.

4. The roller tool according to claim 1, comprising at least two shafts which for transmitting the rotating movement between the tool head and the roller body are oriented so as to be perpendicular to the tool longitudinal axis and are disposed so as to be mutually spaced apart along the tool longitudinal axis.

5. The roller tool according to claim 1, wherein a driving part of the safety clutch is connected directly to the tool head.

6. The roller tool according to claim 1, wherein the roller installation has a secondary roller body which for interacting with the metal sheet is mounted on a roller shaft that transmits the rotating movement so as to be rotatable relative to the roller body.

7. The roller tool according to claim 6, comprising a lubricant duct which for feeding lubricant to the secondary roller body is incorporated in the roller shaft.

8. A roller tool system, comprising the roller tool according to claim 1; and a counter roller tool, with a counter housing; and at least one counter roller which for interacting with a metal sheet is mounted so as to be rotatable in the counter housing.

9. A method for the linear forming of a metal sheet, comprising the following steps:

providing a roller tool for a machine tool, comprising a tool head and a roller installation with at least one roller body;

providing the metal sheet;

pressing the roller body onto the metal sheet by exerting a contact pressure force from a ram of the machine tool onto the tool head;

rotatingly driving the roller body that interacts with the metal sheet by transmitting a rotating movement in a form-fitting manner from the ram to a rotary engagement of the tool head that is configured as a form-fit profile;

repositioning the metal sheet relative to the roller tool for forming the metal sheet in a linear manner;

wherein a maximum torque transmittable between the tool head and the roller body is limited by means of a safety clutch.

10. The method according to claim 9, wherein the rotating driving of the roller body is performed in such a way that it is coupled to the repositioning of the metal sheet relative to the roller tool.

* * * * *